US007008359B2

(12) United States Patent
Fan et al.

(10) Patent No.: US 7,008,359 B2
(45) Date of Patent: Mar. 7, 2006

(54) EXERCISE APPARATUS

(75) Inventors: Wen-Ta Fan, Taichung (TW); Christopher M. Hancock, London (GB); Mark G. Hecox, Hingham, MA (US)

(73) Assignee: Reebok International Ltd., Canton, MA (US)

( * ) Notice: Subject to any disclaimer, the term of this patent is extended or adjusted under 35 U.S.C. 154(b) by 107 days.

(21) Appl. No.: 10/272,989

(22) Filed: Oct. 18, 2002

(65) Prior Publication Data

US 2003/0125173 A1 Jul. 3, 2003

(51) Int. Cl.
*A63B 22/16* (2006.01)

(52) U.S. Cl. ..... 482/146; 482/34; 482/147

(58) Field of Classification Search ..... 482/79, 482/80, 146, 147, 77, 23, 121, 122, 123, 482/126, 127, 95, 96
See application file for complete search history.

(56) References Cited

U.S. PATENT DOCUMENTS

| | | | |
|---|---|---|---|
| 2,803,461 | A | 8/1957 | Coplin |
| 2,978,243 | A | 4/1961 | Gabrielson |
| 3,024,021 | A | 3/1962 | Coplin et al. |
| 3,356,367 | A | 12/1967 | Tewksbury |
| 3,451,672 | A | 6/1969 | Kazdan |
| 3,488,049 | A | 1/1970 | Sasser, Jr. |
| 3,511,500 | A | 5/1970 | Dunn |
| 3,586,321 | A | 6/1971 | Gelurke |
| 3,604,726 | A | 9/1971 | Tracy |
| 3,627,314 | A | 12/1971 | Brown |
| 3,641,601 | A | 2/1972 | Sieg |

(Continued)

FOREIGN PATENT DOCUMENTS

| | | | |
|---|---|---|---|
| DE | 2032544 | A | 1/1972 |

(Continued)

OTHER PUBLICATIONS

MFT Balance Disc, etc., www.myfitnesstrainer.net, available upon information and belief, at least as early as Feb. 2000.

(Continued)

*Primary Examiner*—Gregory L. Huson
*Assistant Examiner*—L. Amerson
(74) *Attorney, Agent, or Firm*—Sterne, Kessler, Goldstein & Fox P.L.L.C.

(57) ABSTRACT

An exercise apparatus including a base, a platform, and a resilient member located between and attached to both the base and the platform. The resilient member can rotate, twist, and tilt in every angle while also providing a resistance force to all degrees of movement. The platform may be modified by the addition of an elastomeric material over its surface to provide additional traction or padding. The platform may also have notches placed around its perimeter, through which resistance tubing or rope may be placed such that upper body resistance motion may be integrated into the exercise apparatus. Furthermore, support members may be disposed under both the platform and base for additional support and rigidity. The resilient member may have a flange, which in conjunction with an adjustment mechanism, may affect the amount of resiliency of the resilient member. The adjustment mechanism may have a handle, a gear and ratchet assembly, and a plurality of locking mechanisms. The adjustment mechanism may be simple and easy to use in that a single movement of the adjustment mechanism will simultaneously adjust the plurality of locking mechanisms and ultimately adjust the overall resiliency of the resilient member.

27 Claims, 9 Drawing Sheets

U.S. PATENT DOCUMENTS 3,758,107 A 9/1973 Potgieter
3,862,768 A 1/1975 England
3,929,329 A 12/1975 Rivera
3,961,787 A 6/1976 Studebaker et al.
D241,863 S 10/1976 Friedl
3,984,100 A 10/1976 Firster
4,065,124 A 12/1977 Egan
4,159,826 A 7/1979 Hancock
4,477,072 A 10/1984 DeCloux
4,491,318 A 1/1985 Francke
4,505,477 A 3/1985 Wilkinson
4,516,767 A 5/1985 Eskijan
4,516,768 A 5/1985 Gallaro
4,592,544 A 6/1986 Smith et al.
4,601,469 A 7/1986 Sasser, Jr.
4,643,419 A 2/1987 Hyde
4,739,986 A 4/1988 Kucharik et al.
4,787,630 A 11/1988 Watson et al.
4,801,140 A 1/1989 Bergeron
4,817,950 A 4/1989 Goo
D306,049 S 2/1990 Bancroft
4,905,994 A 3/1990 Hartz
4,966,364 A 10/1990 Eggenberger
4,971,316 A 11/1990 Dalebout et al.
5,000,444 A 3/1991 Dalebout et al.
5,048,823 A 9/1991 Bean
5,062,629 A 11/1991 Vaughan
5,112,045 A * 5/1992 Mason et al. ..... 482/9
5,116,045 A 5/1992 Jahoda
5,190,506 A 3/1993 Zubik et al.
5,256,127 A 10/1993 Yeh
5,261,864 A 11/1993 Fitzpatrick
5,292,296 A 3/1994 Davignon
5,310,395 A 5/1994 Ko
D347,868 S 6/1994 Hill
5,330,399 A 7/1994 Fan
5,352,176 A 10/1994 Huang
D353,419 S 12/1994 Sprague
5,391,134 A 2/1995 Heatwole
5,399,140 A 3/1995 Klippel
5,415,609 A 5/1995 Yang
D361,604 S 8/1995 Stroppiana
5,522,783 A 6/1996 Gordon
5,536,226 A 7/1996 Gordon
5,549,536 A 8/1996 Clark
5,603,334 A 2/1997 Sharp
5,611,524 A 3/1997 Gordon
5,643,154 A 7/1997 Awbrey et al.
5,643,161 A 7/1997 Gordon
5,643,165 A 7/1997 Klekamp
5,667,462 A 9/1997 Gordon
5,674,166 A 10/1997 Gordon
5,683,337 A 11/1997 Zetocha et al.
5,755,651 A 5/1998 Homyonfer et al.
5,810,703 A 9/1998 Stack
5,851,166 A 12/1998 Bernardson
6,168,551 B1 1/2001 McGuinness
6,401,864 B1 * 6/2002 Stringer et al. ..... 182/148
6,413,197 B1 7/2002 Mckechnie et al.
6,419,611 B1 7/2002 Levine et al.
6,422,983 B1 7/2002 Weck
6,547,703 B1 4/2003 Swezey et al.
6,554,753 B1 4/2003 Weck et al.
6,575,885 B1 6/2003 Weck et al.
6,595,586 B1 7/2003 Brightbill et al.
2002/0077221 A1 6/2002 Dalebout et al.
2003/0195096 A1 10/2003 Hecox et al.

FOREIGN PATENT DOCUMENTS

DE 3150189 A1 7/1983
DE 3620706 A1 12/1987
DE 4105313 8/1992
EP 0134047 A1 3/1985
FR 2410486 6/1979
FR 2592802 7/1987
FR 2624385 6/1989
GB 1372342 10/1974

OTHER PUBLICATIONS

Duradisk Wobble Board, etc., www.paulchekseminars.com, available upon information and belief, at least as early as Feb. 2000.
Exercise Balls; Gymnic Line, etc., www.balldynamics.com, available upon information and belief, at least as early as Feb. 2000.
Dyna-Disc Pillow, etc., www.performbetter.com, available upon information and belief, at least as early as Feb. 2000.
Disc' O' Sit Air Cushion, etc., www.balldynamics.com, available upon information and belief, at least as early as Feb. 2000.
Duradisk, etc., www.paulchekseminars.com. available upon information and belief, at least as early as Feb. 2000.
Sit Fit, www.rpsportsinc.com/balance.htm, available upon information and belief, at least as early as Feb. 2000.
K.A.T. 2000, www.oemmedical.com, (printed Jan. 10, 2000) (2 pages).
K.A.T. 500 product sheet, available upon information and belief, at least as early as Feb. 2000.
Lower Extremity, Exercise Equipment (K. A. T. Products), available upon information and belief, at least as early as Feb. 2000.
K.A.T. 550 product sheet, available upon information and belief, at least as early as Feb. 2000.
Pogo Ball Drawing, available upon information and belief, at least as early as Feb. 2000.
www.myfitnesstrainer.net, 4 selected screen shots (printed Feb. 26, 2001).
Jump Board: Digital Photographs showing a toy called a "jump board" made by Hedstrom Corporation, available upon information and belief, at least as early as Feb. 2000.
Sep. 8, 2004 Office Action from co-pending U.S. Appl. No. 10/446,778, filed May 29, 2003.
Dec. 15, 2004, Office Action from co-pending U.S. Appl. No. 09/737,392, filed Dec. 15, 2000.

* cited by examiner

EXERCISE APPARATUS

BACKGROUND OF THE INVENTION

1. Field of the Invention

The present invention relates to the field of exercise equipment. In particular, it relates to an adjustable exercise apparatus for increasing an individual's strength, agility, balance, and cardiovascular endurance.

2. Related Art

There are many different activities in daily life that require individuals to use their strength, agility, and balance. Furthermore, many of today's sports require even more developed abilities. In order to improve upon the skills needed for these activities many people have turned to various forms of exercise equipment designed to isolate and target the areas of the body used in these activities.

The initial movement in this area of exercise equipment led to the design of several different apparatuses concentrated on balancing. Similar designs have also been developed for use in physical therapy. While many of these designs promote the development of the user's muscles and balance, the extent of such development is limited by the basic design of the apparatus. The design of the apparatus often limits the amount of development of the user and can also lead to a lack of interest of the user.

An exercise apparatus is needed that allows for adjustment in the level of difficulty of use, as well as optional uses, which would result in the involvement of other areas of the body and ultimately in a total body workout. Essentially, an exercise apparatus with another dimension of challenge is needed.

The initial movement into this area of exercise equipment led to the apparatus disclosed in co-pending U.S. application Ser. No. 09/927,435, filed on Aug. 13, 2001. The disclosed apparatus allows the user to adjust the resiliency of the resilient member to diminish or exaggerate the movement of the platform of the apparatus. The present invention also allows the user to adjust the apparatus, but in a different mechanical manner than disclosed in co-pending U.S. application Ser. No. 09/927,435.

SUMMARY OF THE INVENTION

To achieve the foregoing and other objects, and in accordance with the purposes of the present invention as embodied and broadly described herein, the present invention provides an exercise apparatus having a base, a platform, and a resilient member disposed between the base and the platform. The resilient member allows for rotation of the platform about at least two axes of rotation. Additionally, an adjustment mechanism is provided, which, with a single movement of a handle of the adjustment mechanism, allows for simultaneous radial adjustment of a plurality of locking mechanisms arranged around the periphery of the resilient member.

The adjustment mechanism includes a handle, a gear and ratchet assembly, and a plurality of locking mechanisms. Each of the locking mechanisms is arranged radially opposite of and attached to, via a ratchet, another of the locking mechanisms. Two of the locking mechanisms include inner ratchets, which allow the locking mechanisms to move relative to a gear. A centrally-located gear tracks both of the ratchets. The gears and ratchets allow for synchronized movement of the locking mechanisms between an engaged position and a disengaged position.

Use of the adjustment mechanism changes the resiliency of the resilient member. During adjustment, the locking mechanisms move radially along a ratchet of the gear and ratchet assembly. There are two settings available for the locking mechanisms, an engaged setting and a disengaged setting. When the mechanism is adjusted inwardly (e.g., engaged), the locking mechanisms move radially inwardly to engage the resilient member, thereby increasing the resiliency of the resilient member. When the mechanism is adjusted outwardly (e.g., disengaged), the locking mechanisms move radially outwardly to disengage the resilient member, thereby decreasing the resiliency of the resilient member.

BRIEF DESCRIPTION OF THE DRAWINGS

The foregoing and other features and advantages of the invention will be apparent from the following, more particular description of a preferred embodiment of the invention, as illustrated in the accompanying drawings.

DETAILED DESCRIPTION OF THE INVENTION

A preferred embodiment of the present invention is now described with reference to the figures, where like reference numbers indicate identical or functionally-similar elements. While specific configurations and arrangements are discussed, it should be understood that this is done for illustrative purposes only. A person skilled in the relevant art will recognize that other configurations and arrangements can be used without departing from the spirit and scope of the invention.

Figure 1:
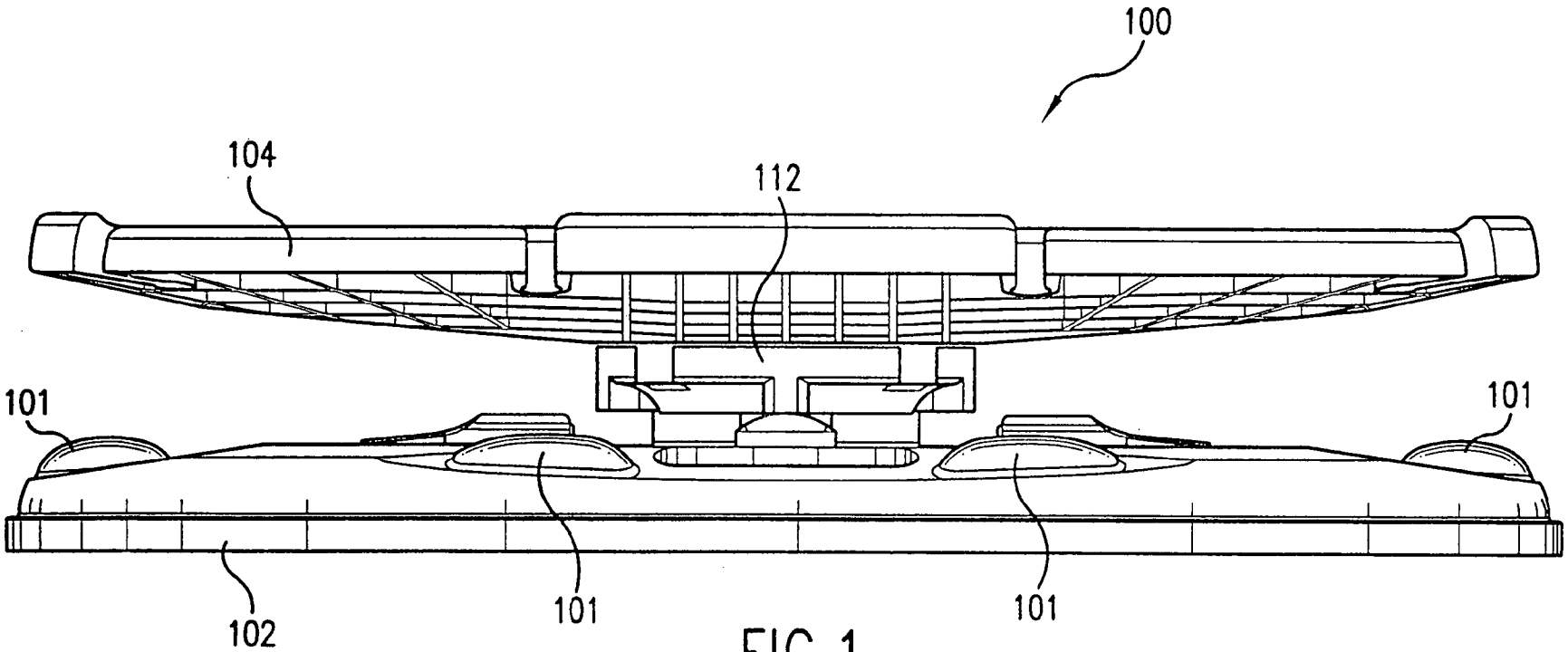
FIG. 1 is a side view of an exercise apparatus of the present invention.

Referring to the drawings, FIG. 1 depicts a side view of an exercise apparatus 100 of the present invention, which includes a base 102, with bumper pads 101, a platform 104 disposed above base 102, and a resilient member 112 disposed between base 102 and platform 104. In one embodiment, platform 104 and base 102 are composed of an aluminum honeycomb material, thereby making apparatus 100 light-weight and strong. In this embodiment, a composite is formed from an aluminum honeycomb core laminated on both sides with sheet aluminum through a process utilizing heat and pressure. Additionally, bumper pads 101 are composed of a resilient, shock-absorbing material, for example rubber.

Figure 9:
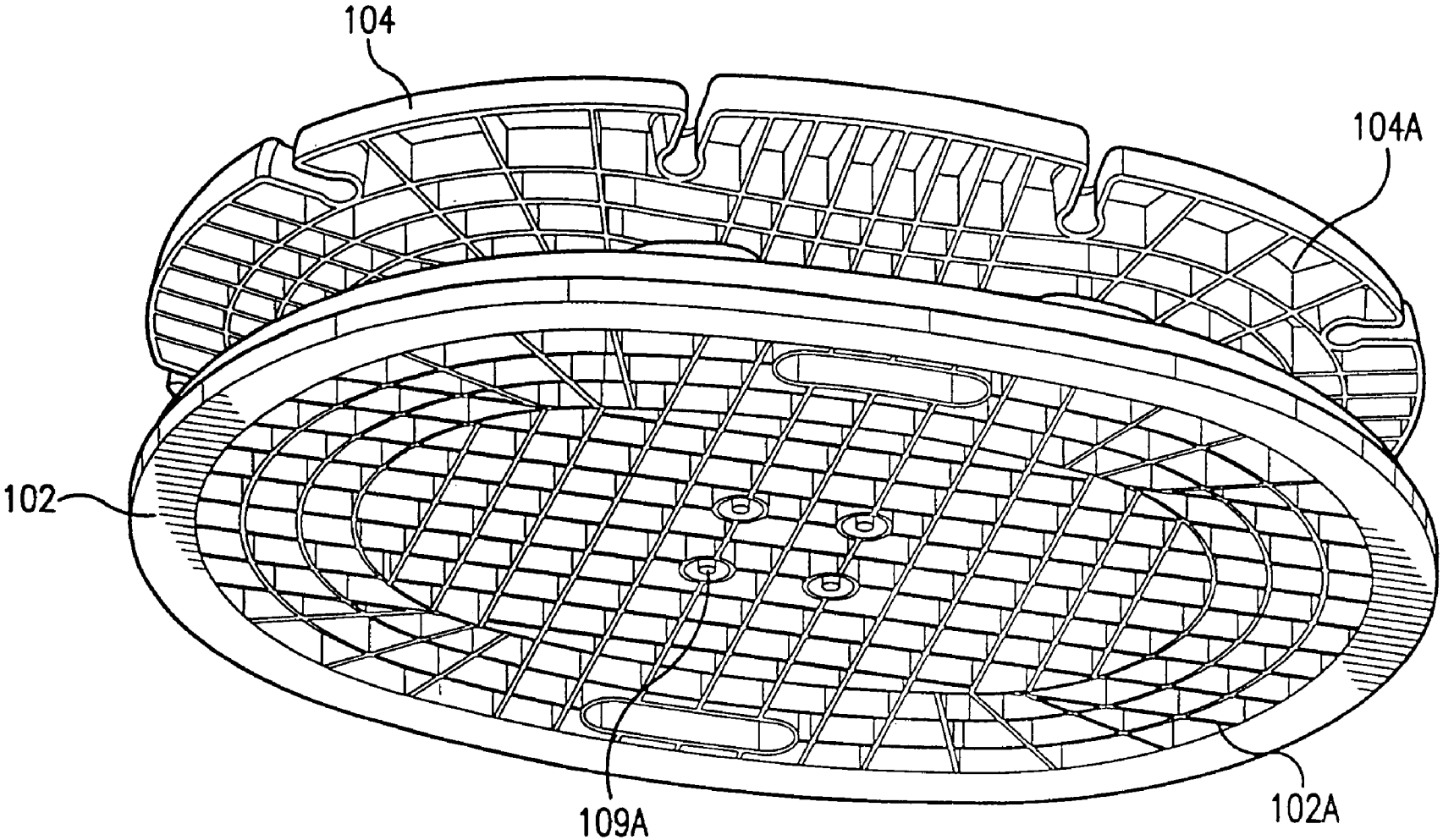
FIG. 9 is a bottom perspective view of the exercise apparatus of FIG. 1.

In another embodiment, platform 104 is molded of a high-strength-plastic material. Alternatively, platform 104 can be formed from a fiberglass core with a Kevlar skin, or from carbon fiber. As shown in FIG. 9, platform 104 can be formed to include support members 104A on a bottom surface of platform 104. Platform support members 104A, in one embodiment, are downwardly projecting extensions on the bottom surface of platform 104, which form a grid-like pattern. It would be apparent to one skilled in the relevant art that other support structures could also be used to provide added stability and rigidity to platform 104. Base 102 also has bolt holes 109A formed therein, to allow attachment of a resilient member 112 (not shown). It would be apparent to one skilled in the relevant art that alternative means other than bolts may be used, for example rivets, or more permanent welds.

Similarly, base 102 can also be molded from a high-strength plastic or similar materials as platform 104. Base 102 can further be formed with base support members 102A on a bottom surface of base 102. Base support members 102A, in one embodiment, are downward projecting extensions on the bottom surface of base 102, which form a grid-like pattern. It would be apparent to one skilled in the relevant art that other support structures could also be used to provide added stability and rigidity to base 102.

Figure 2:
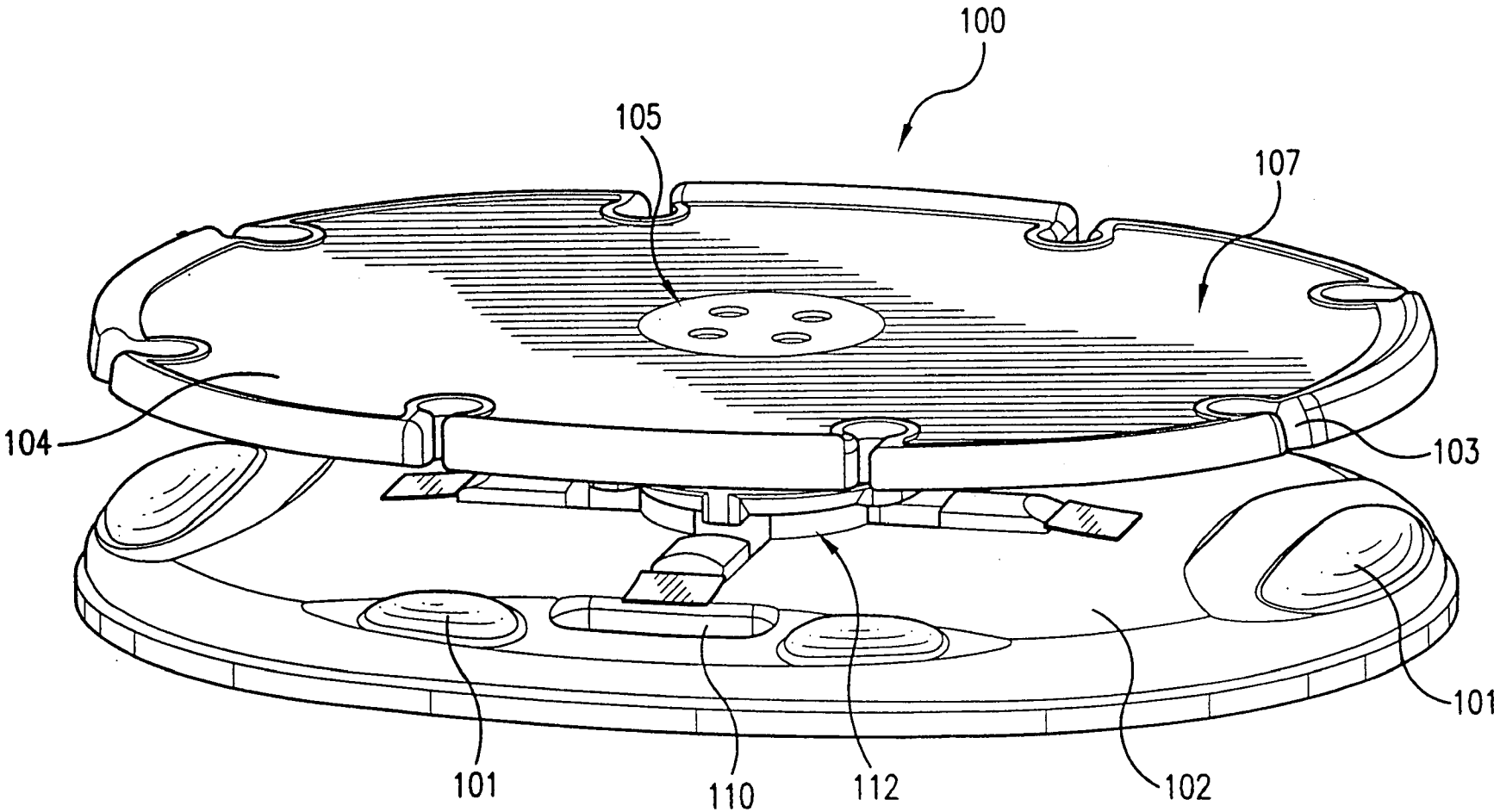
FIG. 2 is a top perspective view of the exercise apparatus of FIG. 1.
Figure 3:
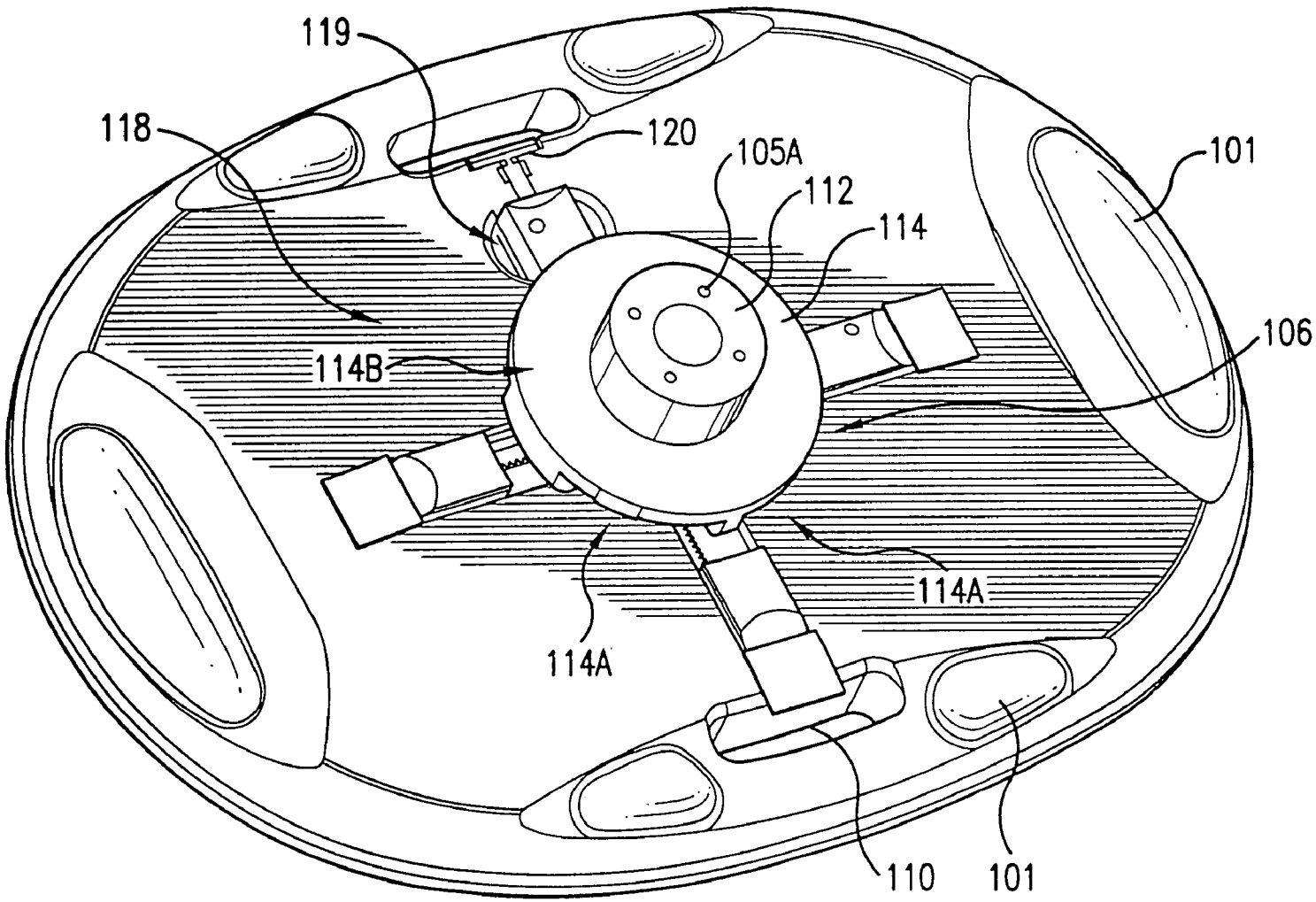
FIG. 3 shows the exercise apparatus with the platform removed and clearly depicting the resilient member.

Platform 104 is shown in further detail in FIG. 2. Notches 103 are located around the perimeter of platform 104. Notches 103 allow a user to attach rope or rubber hosing to apparatus 100 so as to permit the inclusion of arm movements into the exercise performed on the apparatus. In one embodiment, notches 103 are shaped as a key hole in order to hold a rope, elastic resistance tubing, or the like in position during use of apparatus 100. It would be apparent to one skilled in the relevant art that other shapes, such as "L"-shaped slots, could be used for notches 103. In still a further embodiment, a rope or tubing or the like could be attached, either removable or permanently, to the apparatus, and the notches 103 could be used simply as guides. Still further, handles could be attached to the ends of the rope or tubing. Also, a mechanism could be attached to the apparatus to retract the rope or tubing when not in use.

Platform 104 includes bolt holes 105 to attach platform 104 to a resilient member 112. In one embodiment, bolt holes 105 include a recess to allow for bolts (not shown) to lay flush with the top surface of platform 104. Additionally, in one embodiment, upper surface 107 of platform 104 is constructed from a non-skid elastomeric material. In another embodiment, a non-slip material, such as elastomeric material, is stretched across upper surface 107 of platform 104. It would be apparent to one skilled in the art that various coverings could be placed over upper surface 107 of platform 104 to alter both its texture and appearance. In yet another embodiment, a plurality of handles 110 for carrying the apparatus 100 are formed in base 102.

FIGS. 3–6 collectively show in detail a resilient member 112 and an adjustment mechanism 118 for adjustment of resilient member 112. Resilient member 112 has bolt holes 105A formed therein to allow attachment of resilient member 112 to platform 104 by bolts (not shown).

In one example, resilient member 112 is a natural rubber cylinder. Additionally, resilient member 112 can be made of any of a variety of materials. For example, resilient member 112 may be made of an elastomer or polymer of various resiliency. The dimensions of the resilient member will vary depending on the material used to construct the resilient member.

Resilient member 112 includes a flange 114 with cutouts 114A formed therein to allow sufficient twisting and bending in accordance with the exercise being performed. It would be apparent to one skilled in the art that the size and shape of cutouts 114A could be modified to produce different twisting and bending properties of resilient member 112. Flange 114 has a top surface 114B, on which platform 104 sits and which distributes the load applied to platform 104. Flange 114 may be comprised of an elastomer or polymer of various resiliency. One example of a material for flange 114 is a material containing polytetrafluoroethylene (PTFE), such as Teflon, Fluoron or Nylon. Alternatively, flange 114 can be made of any variety of other materials, as would be apparent to one skilled in the art. Flange 114, in addition to the adjustment mechanism described in detail below, allows the user to control the degree of difficulty of use of the apparatus.

Figure 4:
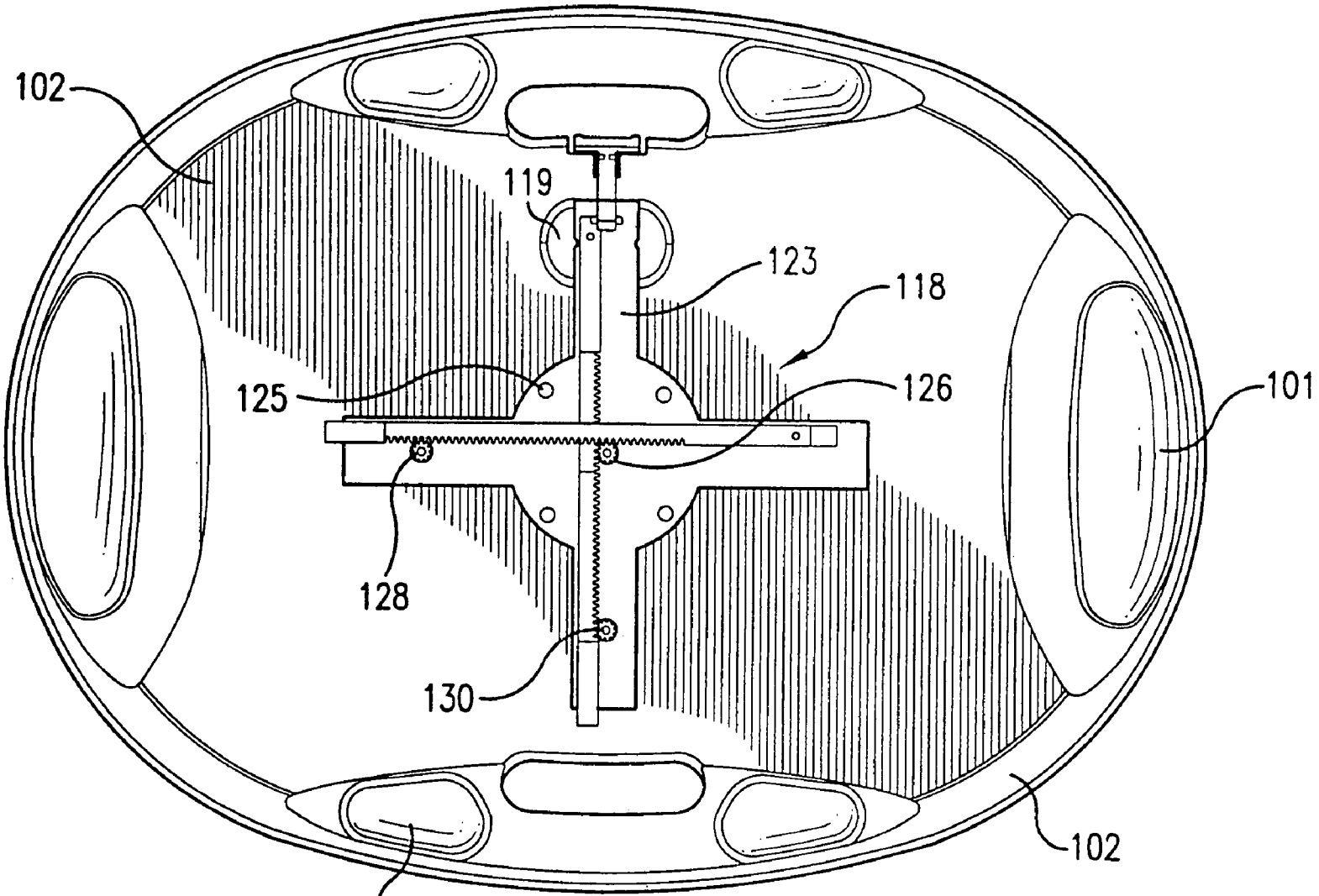
FIG. 4 shows a bottom view of the base of the exercise apparatus.

Located under resilient member 112 is an adjustment mechanism 118. In one embodiment, adjustment mechanism 118, as seen in FIG. 4, sits in a recess 123 formed in base 102. Gears 126, 128, and 130 are attached to base 102 and facilitate movement of adjustment mechanism 118.

Figure 5:
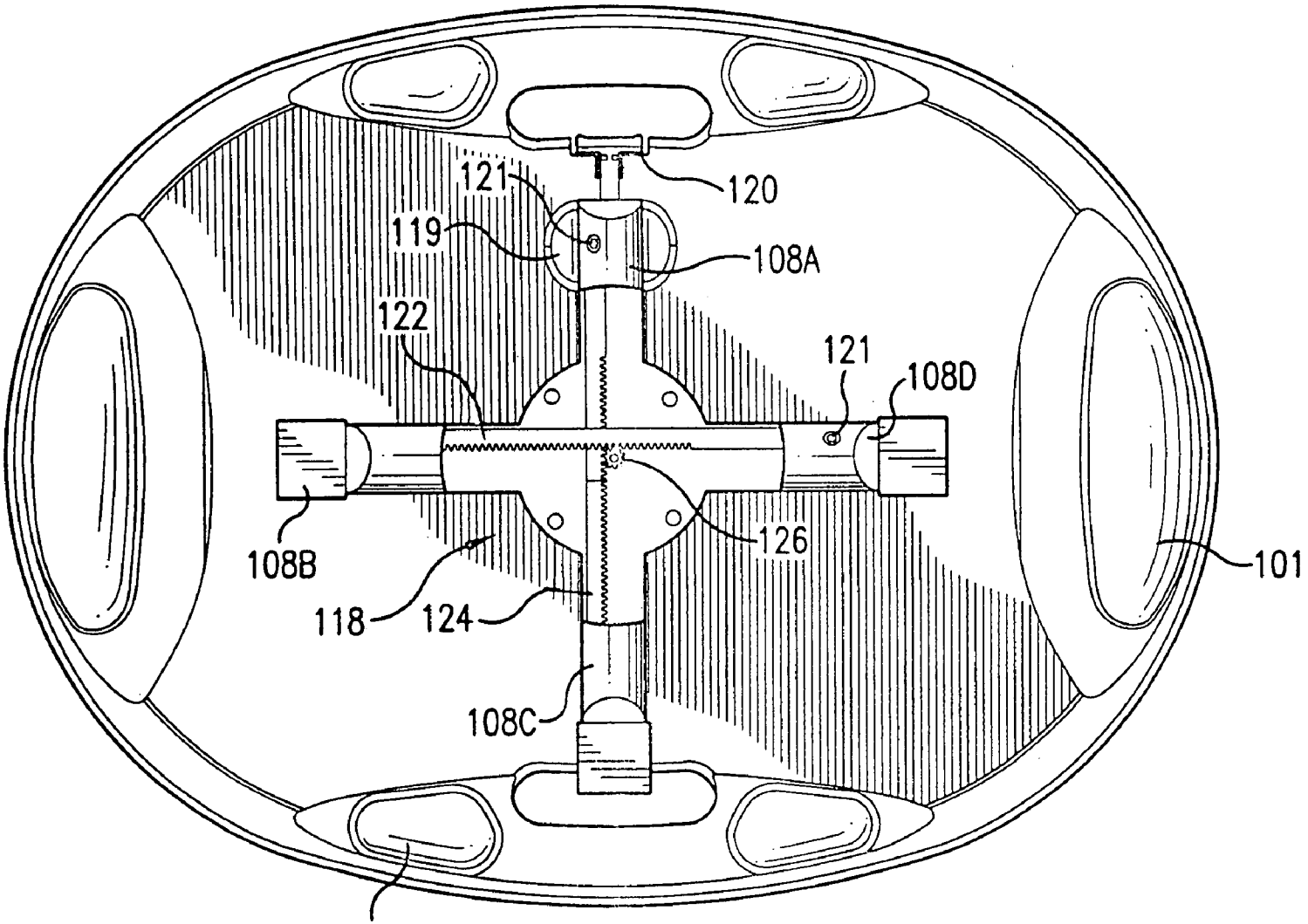
FIG. 5 shows the exercise apparatus with the platform and resilient member removed and clearly depicting the adjustment mechanism with the locking mechanisms in the outward, disengaged position.

Further, FIG. 5 depicts adjustment mechanism 118, comprising an adjustment handle 120, a plurality of locking mechanisms 108A–D, ratchets 122 and 124, and gears 126, 128 (not shown), and 130 (not shown). Adjustment mechanism 118 is in the radially-outward position. The locking mechanisms slide radially inwardly and outwardly under flange 114 (not shown). The locking mechanisms 108A–D are made of any of a variety of solid and light-weight materials, for example a hard plastic. When the locking mechanisms 108A–D are in their radially inward position, flange 114 abuts the locking mechanisms 108A–D, thereby reducing the range of motion of platform 104 radially outward position, outer edge 106 (See FIG. 3) of flange 114 clears the locking mechanisms 108A–D, thereby increasing the range of motion of platform 104 about various axes of rotation. Handle 120 is attached to locking mechanism 108A. Locking mechanisms 108A and 108D are attached to ratchets 124 and 122 respectively, via a fastener 121. Fastener 121 may be for example a screw, bolt, or rivet. Locking mechanisms 108A–D interact with each other via ratchets 122 and 124, which are operatively connected to each other by gear 126.

Figure 6:
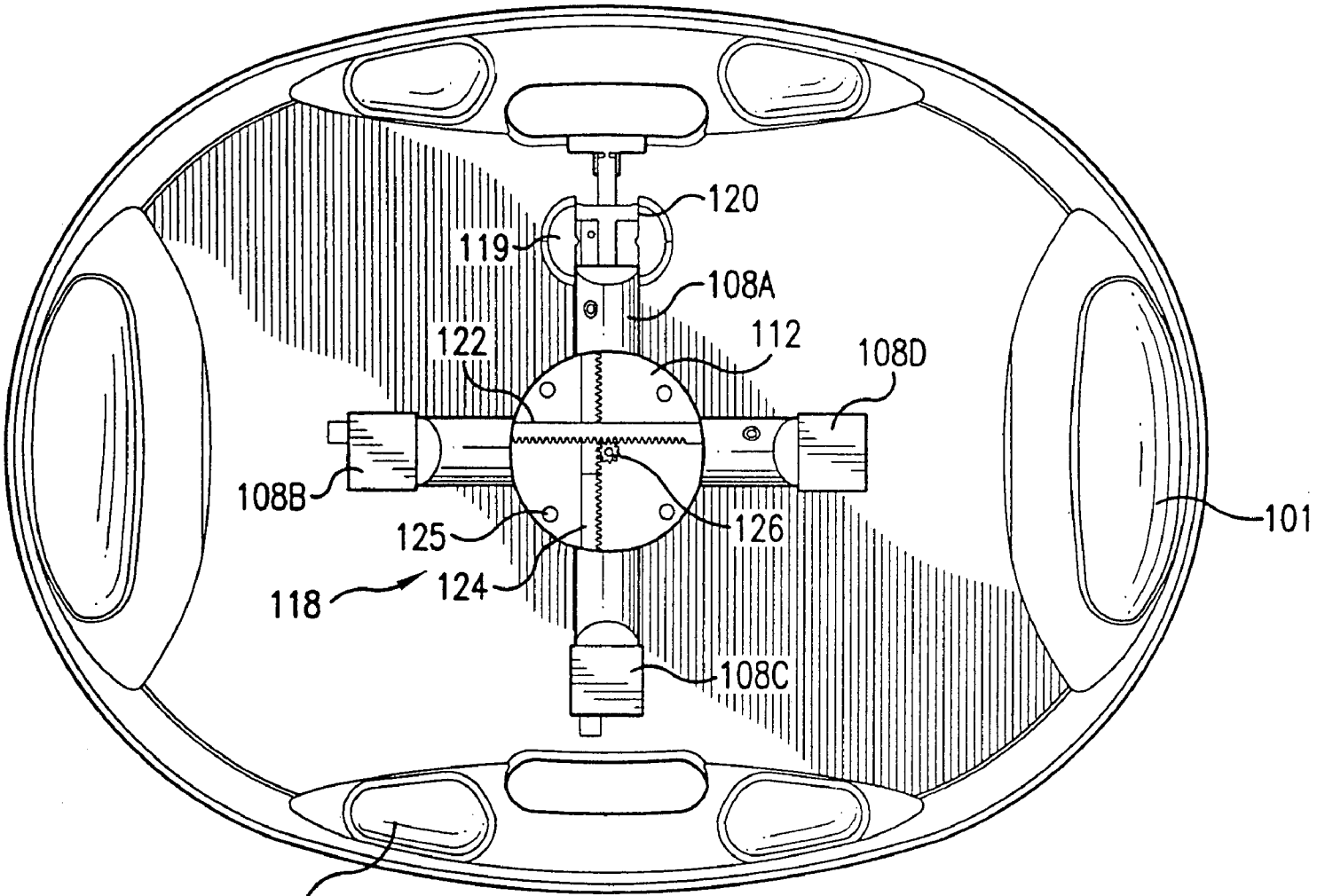
FIG. 6 shows the exercise apparatus with the platform and resilient member removed and clearly depicting the adjustment mechanism with the locking mechanisms in the inward, engaged position.

FIG. 6 depicts adjustment mechanism 118 with locking mechanisms 108A–D in the inward position. Resilient member 112 has a plurality of bolt holes 125 formed therein to allow attachment of resilient member 112 to adjustment mechanism 118 and ultimately to base 102 by bolts (not shown). Handle 120 is recessed in base 102 in both the radially-inward position (shown in FIG. 6) and radially-outward position (shown in FIG. 5). There exists finger groove 119, between handle 120 and base 102 to allow the user to grasp handle 120 and remove it from the recess.

Figure 7:
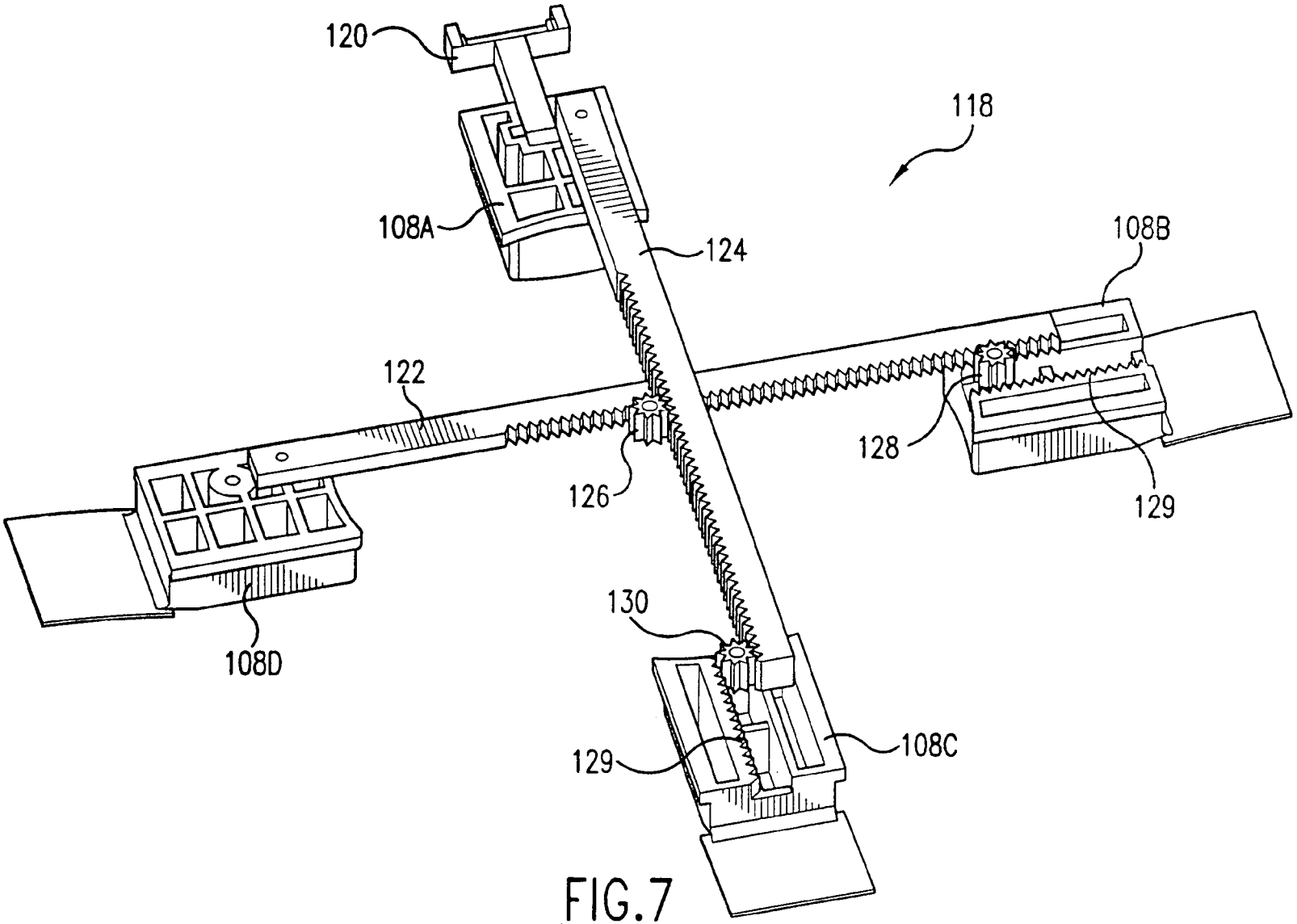
FIG. 7 shows a bottom view of the adjustment mechanism.
Figure 8:
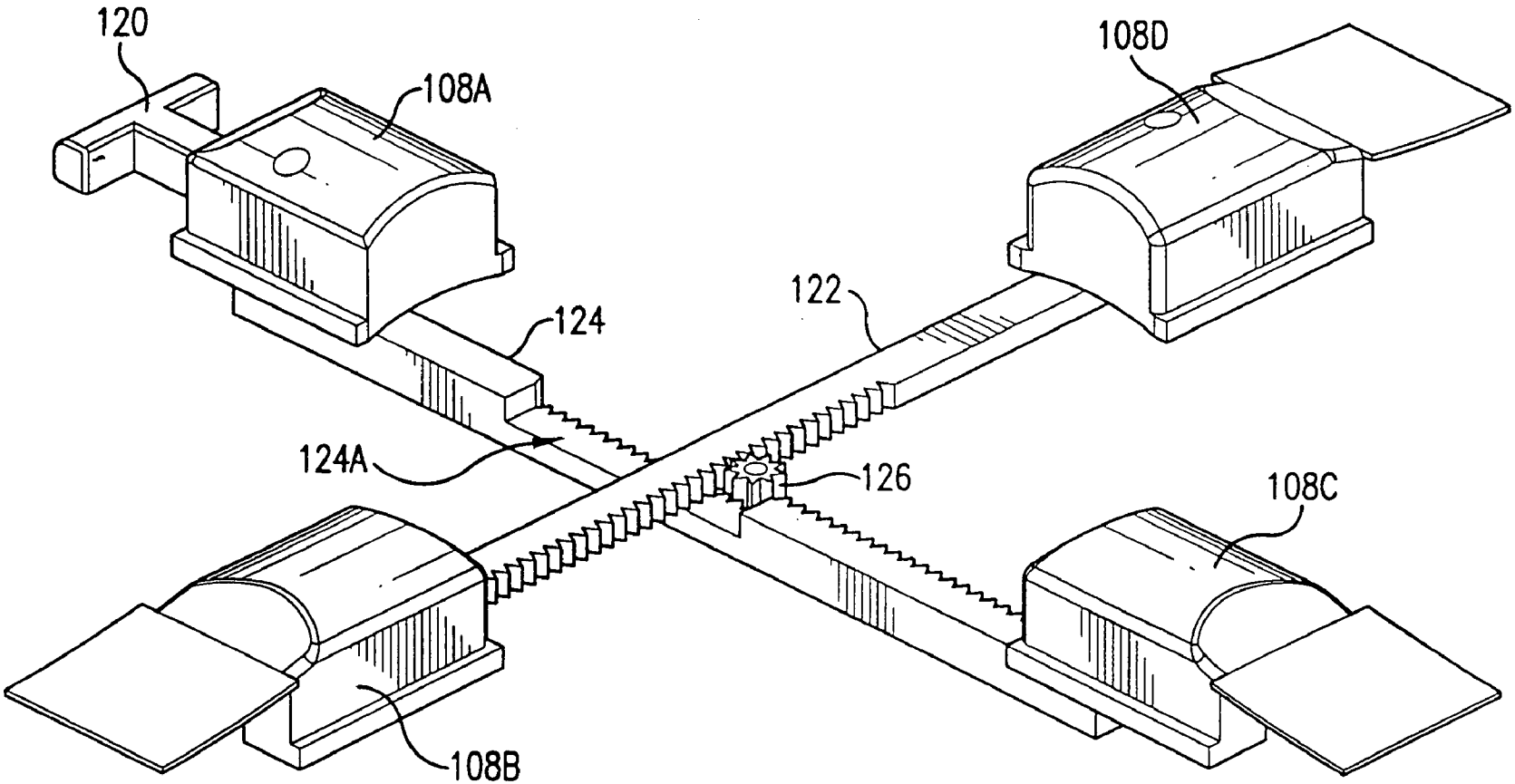
FIG. 8 shows a top view of the adjustment mechanism.

FIG. 7 shows a bottom view of adjustment mechanism 118. Two locking mechanisms 108B and 108C, with inner ratchets 129, track along gears 128 and 130 respectively, which allow the respective locking mechanisms 108B and 108C to move relative to ratchets 122 and 124. In use, when handle 120 is moved radially outwardly, ratchet 124 also moves radially outwardly. Gear 130, and inner ratchet 129 on the bottom of locking mechanism 108C, cause this locking mechanism to move radially outwardly also. At the same time, gear 126 moves ratchet 122, and locking mechanism 108D radially outwardly. This in turn moves locking mechanism 108B, using gear 128, radially outwardly also. FIG. 8 shows a top view of adjustment mechanism 118.

Ratchet cutout 124A, along with gear 126, facilitates movement of ratchets 122 and 124 relative to each other.

In one use of apparatus 100, the user places apparatus 100 on a flat surface. To decrease the resiliency of apparatus 100, the user will lift handle 120 from its recess and move it outward. In doing so, locking mechanism 108A and ratchet 124 move outwardly. As ratchet 124 moves in the radially-outward direction with handle 120, gear 130 tracks along ratchet 124, and inner ratchet 129 of locking mechanism 108C, and in doing so moves locking mechanism 108C outwardly also. Simultaneously, ratchet 124 moves gear 126, which will cause ratchet 122 to move in a direction that causes locking mechanism 108D to move radially outwardly. As ratchet 122 moves in such an outward direction, gear 128 tracks along ratchet 122 and inner ratchet 129 of locking mechanism 108B, thereby moving locking mechanism 108B in an outward direction also. When the user has moved handle 120 to the outward, disengaged position, handle 120 is returned to a recess in its outward position. With locking mechanisms 108A–D in the disengaged position, flange 114 has a greater range of motion and platform 104 may also have a greater range of motion. Consequently, apparatus 100 will provide the user with a less resilient and more challenging mode of use for any one of the user's choice of exercises.

While the invention has been particularly shown and described with reference to preferred embodiments thereof, it will be understood by those skilled in the art that various changes in form and details may be made therein without departing from the spirit and scope of the invention.

Description of Exercises

Apparatus 100 of the present invention is intended to be used to perform a variety of exercises. Provided herein are several examples of exercises that can be performed using apparatus 100.

Hip Hinge

Areas Exercised: Hip extensors, erector spinae

1) Start with feet together in the center of the board in the ready position and with soft knees. Place hands on hips.
2) Hinge forward from the hips (forward flexion), keeping the spine neutral and knees slightly bent. Do not bend past 90 degrees. Engage the glutes and return to the starting position without rounding the back.
3) For a greater challenge, lift one leg as you hinge forward making the hip joint to pivot point. You will be off center so try to maintain your balance, while keeping the knee on your balance leg slightly bent and the core muscles engaged throughout.

Squats

Areas Exercised: Hip stabilizers, gluteal, hamstrings, quads

1) Stand in the center of the board, with the feet hip-width apart in the ready position.
2) Slowly bend at the hips and knees to lower buttocks towards the floor, keeping the chest up, shoulders down and with a neutral spine (imagine sitting in a chair). Press into the board with your feet and return to starting position.
3) For a greater challenge, start with both feet off to one side and step off the side of the board as you squat, maintaining alignment and even weight between both feet. At no time should your knees be in front of your feet.

Lunges

Areas Exercised: Hip stabilizers, glueteals, hamstrings, quads, hip adductors, hip abductors (lateral lunges)

1) Stand with both feet on the board, left and right of the center of the board.
2) Step forward or backwards off the back of the board, keeping the front knee over the ankle and not flexing either knee past 90 degrees.
3) For a greater challenge, start with both feet off of the board and step onto the board, performing the lunge. Each time you step onto the board, step on a different area of the board keeping your core muscles engaged throughout the movement.

Push-Ups

Areas Exercised: Shoulder girdle stabilizers, pectoral muscles, triceps

1) Start with hand on the board, legs extended behind you, feet together, and maintain a neutral spine. For a modified position, start with knees on the floor.
2) Slowly lower the body towards the board maintaining alignment with the core muscles engaged. Press back up to start position.
3) For a greater challenge lift one leg up as you lower your body towards the board.

Seated Exercises

Areas Exercised: Abdominal stabilizers, trunk rotators

1) Start seated a little forward of the center of the board with knees bent, feet together and back straight.
2) Holding a dowel or a towel between both hands, lean back slightly and begin rotating the torso right and left. Keep your abs pulled in and don't allow your back to arch.
3) For a greater challenge move the knees in the opposite direction as you rotate the torso.

Bridges

Areas Exercised: Hip stabilizers, hip extensor, hamstrings

1) Lie on your back with your feet hip-width apart on the board and hands by your sides.
2) Execute a hip extension by lifting the hips off ground and extending hips toward the ceiling. Keep the core muscles engaged and the ribs soft. Roll down one vertebra at a time.
3) For a greater challenge, move one foot to the center of the board and extend the other up to the ceiling. Execute the hip extension on one leg.

Quadruped Exercises

Areas Exercised: Abdominal, lumbar and shoulder stabilizers, shoulder extensors, hip extensors 1) Start with both hands wide on the board and knees on the floor.
2) Lift one leg off the floor to complete extension and hold parallel to the floor. Hold for a three count, return to the floor and alternate legs.
3) For a greater challenge, life one art and the opposite leg and hold for three breaths, making sure to keep the spine neutral and the core muscles engaged. Lower to the starting position and repeat on the other side.

Back Extensions

Areas Exercised: Lumbar, back extensors

1) Start lying face down on the board with your hands resting lightly behind your head and toes pointed.
2) Slowly lift your chest off the board while maintaining balance and then lower your chest.

3) For a greater challenge and to make it more difficult to balance, as you lift your chest off the ground, simultaneously lift your feet off the ground.

Side Lying Exercise

Areas Exercised: Quadratus lumbarum, gluteus medius

1) Start with the elbow and forearm on the board, hips on the floor with the knees bent and the legs stacked—one on top of the other.
2) Slowly lift the hips off the floor keep the spine neutral and the core muscles engaged. Lower down to start position.
3) For a greater challenge, keep legs straight, but not locked. To increase difficulty again, raise your arm to the ceiling and/or lift up your top leg six inches. Remember to engage your core muscles throughout.

What is claimed is:

1. An exercise apparatus comprising:

a base;

a platform;

a resilient member disposed between the base and the platform, wherein the resilient member is fixedly connected to the base and the platform; and an adjustment mechanism, including a plurality of locking mechanisms configured to slide radially and engage a bottom surface of the resilient member.

2. An exercise apparatus as set forth in claim 1, wherein the adjustment mechanism includes a gear and ratchet assembly.

3. An exercise apparatus as set forth in claim 2, wherein the adjustment mechanism includes a handle.

4. An exercise apparatus as set forth in claim 1, wherein the plurality of locking mechanisms comprises four locking mechanisms.

5. An exercise apparatus as set forth in claim 2, wherein the locking mechanisms are configured to move radially along a ratchet of the gear and ratchet assembly.

6. An exercise apparatus as set forth in claim 5, wherein there are two adjustment positions for the adjustment mechanism.

7. An exercise apparatus as set forth in claim 6, wherein the two adjustment positions are a radially-inward position and a radially-outward position.

8. An exercise apparatus as set forth in claim 7, wherein the locking mechanisms are disengaged from the resilient member in the radially-outward position.

9. An exercise apparatus as set forth in claim 7, wherein the locking mechanisms are engaged with the resilient member in the radially-inward position.

10. An exercise apparatus as set forth in claim 1, wherein the plurality of locking mechanisms are attached to each other by at least one ratchet.

11. An exercise apparatus as set forth in claim 10, further comprising a centrally-located gear.

12. An exercise apparatus as set forth in claim 11, wherein the ratchet is configured to move the locking mechanism from a radially-inward position to a radially-outward position.

13. An exercise apparatus comprising:

a base;

a platform;

a resilient member disposed between the base and the platform, wherein the resilient member is fixedly connected to the base and the platform; and, means for adjusting resiliency of the resilient member, said means for adjusting resiliency comprising a plurality of locking mechanisms symmetrically arranged around a periphery of said resilient member and configured to engage a bottom surface of the resilient member.

14. An exercise apparatus comprising:

a base;

a platform, a resilient member disposed between the base and the platform, wherein the resilient member is connected to the base and the platform and allows rotation of the platform about at least two axes of rotation; and a handle, for carrying the exercise apparatus, wherein the handle is a deep indentation formed in one of the base and the platform.

15. An exercise apparatus as set forth in claim 14, wherein the handle is an opening formed in the base.

16. An exercise apparatus comprising:

a base;

a platform;

a resilient member disposed between the base and the platform, wherein the resilient member is fixedly connected to the base and the platform; and, an adjustment mechanism engaged with the resilient member, the adjustment mechanism including at least one gear and at least one ratchet.

17. An exercise apparatus as set forth in claim 1, wherein the adjustment mechanism is disposed in a recess formed in the base.

18. An exercise apparatus as set forth in claim 13, wherein the plurality of locking mechanisms are configured to slide between a radially-inward position and a radially-outward position.

19. An exercise apparatus as set forth in claim 18, wherein the locking mechanisms are configured to engage the bottom surface of the resilient member in the radially-inward position and to disengage the bottom surface of the resilient member in the radially-outward position.

20. An exercise apparatus as set forth in claim 13, further comprising a handle for carrying the exercise apparatus, wherein said handle is formed in the base.

21. An exercise apparatus as set forth in claim 13, further comprising a plurality of notches formed in the platform.

22. An exercise apparatus as set forth in claim 13, wherein said means for adjusting resiliency further comprises a handle attached to a locking mechanism and configured to move the locking mechanism radially inward and outward.

23. An exercise apparatus as set forth in claim 16, wherein the adjustment mechanism is disposed in a recess formed in the base.

24. An exercise apparatus as set forth in claim 16, wherein the at least one gear is attached to the base.

25. An exercise apparatus as set forth in claim 16, wherein the at least one gear is operatively connected to the at least one ratchet, wherein the ratchet is configured to move radially inwardly and outwardly along the base.

26. An exercise apparatus as set forth in claim 16, wherein the adjustment mechanism includes a handle configured to move the ratchet radially inwardly and outwardly.

27. An exercise apparatus as set forth in claim 26, wherein the handle is removably recessed in the base.

* * * * *